US007097575B1

(12) United States Patent
Chen

(10) Patent No.: US 7,097,575 B1
(45) Date of Patent: Aug. 29, 2006

(54) NET-POST ASSEMBLY FOR BALL GAME

(76) Inventor: Benjiman Chen, No. 9, Chunting 1st St., Yatan Rd, Daya Township, Taichung County (TW) 428

( * ) Notice: Subject to any disclaimer, the term of this patent is extended or adjusted under 35 U.S.C. 154(b) by 0 days.

(21) Appl. No.: 11/101,247

(22) Filed: Apr. 7, 2005

(51) Int. Cl.
*A63B 71/00* (2006.01)

(52) U.S. Cl. ..... 473/494

(58) Field of Classification Search ..... 473/492, 473/494, 467, 473; 248/539
See application file for complete search history.

(56) References Cited

U.S. PATENT DOCUMENTS 1,819,768 A * 8/1931 Coffing ..... 248/539
3,860,240 A * 1/1975 Koch ..... 473/467
3,940,139 A * 2/1976 Barnes ..... 473/494
4,249,182 A * 2/1981 Rupley ..... 343/715
4,264,048 A * 4/1981 Silbernagel ..... 248/229.17
5,954,308 A * 9/1999 Lane et al. ..... 248/539
6,830,522 B1 * 12/2004 Chen ..... 473/494

* cited by examiner

*Primary Examiner*—Raleigh W. Chiu
(74) *Attorney, Agent, or Firm*—Charles E. Baxley

(57) ABSTRACT

The present invention relates to a net-post assembly that can fix and release the net more quickly and easily. The net-post assembly comprises a rod, a quick release member inserted in the through hole of the rod, a first clamping member, a second clamping member, and a fastener. The net can be clamped between the second clamping member and the fastener easily by the adjusting the quick release member.

4 Claims, 6 Drawing Sheets

NET-POST ASSEMBLY FOR BALL GAME

BACKGROUND OF THE INVENTION

1. Field of the Invention

The present invention relates to a net-post assembly for ball game, and more particularly to a net-post assembly that can fix and release the net more quickly and easily.

2. Description of the Prior Arts

Referring to FIG. 1, which shows a vertical aerial assembly for volleyball disclosed by U.S. Pat. No. 563,916.

In assembly, the user screws the upper screw member 10 with the threaded portion 111 of the upper fixing rod 11 and make the upper screw member 10 rest on the inner surface of the upper hook 12, and thus an upper edge net (not shown) can be clamped between the upper screw member 10 and the upper hook 12.

And then the user can screw the lower screw member 13 with the threaded portion 141 of the lower fixing rod 14 and make it rest on the inner surface of the lower fixing rod 14, so as to clamp the lower edge of the net between the lower fixing rod 14 and the lower screw member 13.

However, during the assembly and disassembly of the vertical aerial assembly, the user has to rotate the upper and lower screw members 10, 13 relative the upper and lower fixing rods 11, 14, in order to clamp the upper edge of the net between the upper screw member 10 and the upper fixing rod 12, and retain the lower edge of the net between the lower screw member 13 and the lower fixing rod 15. Rotating the screw is really not easy and time-consuming.

The present invention has arisen to mitigate and/or obviate the afore-described disadvantages.

SUMMARY OF THE INVENTION

The primary objective of the present invention is to provide a net-post assembly that can fix and release the net more quickly and easily. The net-post assembly comprises a rod, a quick release member inserted in the through hole of the rod, a first clamping member, a second clamping member, and a fastener. The net can be clamped between the second clamping member and the fastener easily by the adjusting the quick release member.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
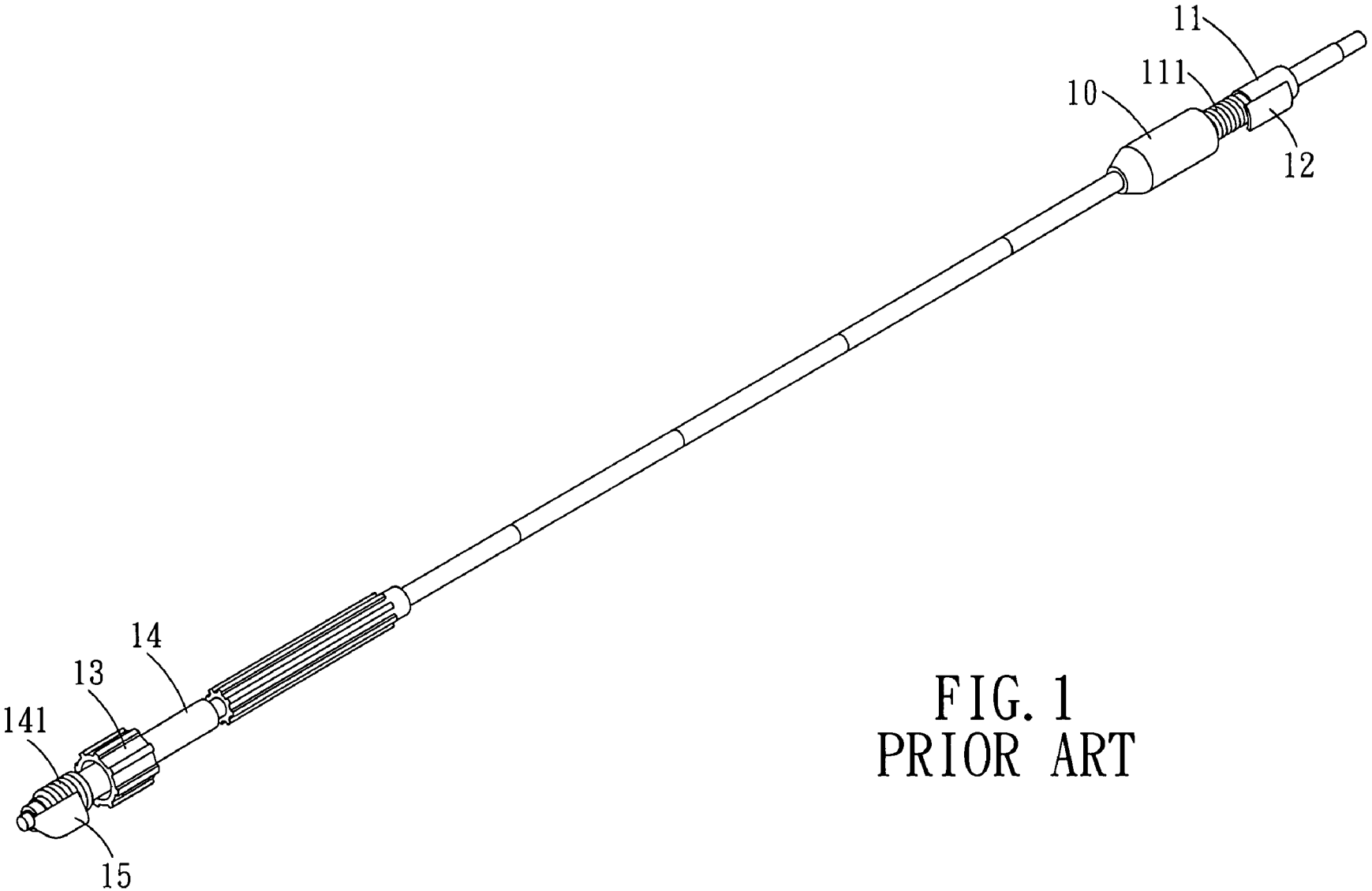
FIG. 1 PRIOR ART
FIG. 1 shows a conventional vertical aerial assembly for volleyball.
Figure 2:
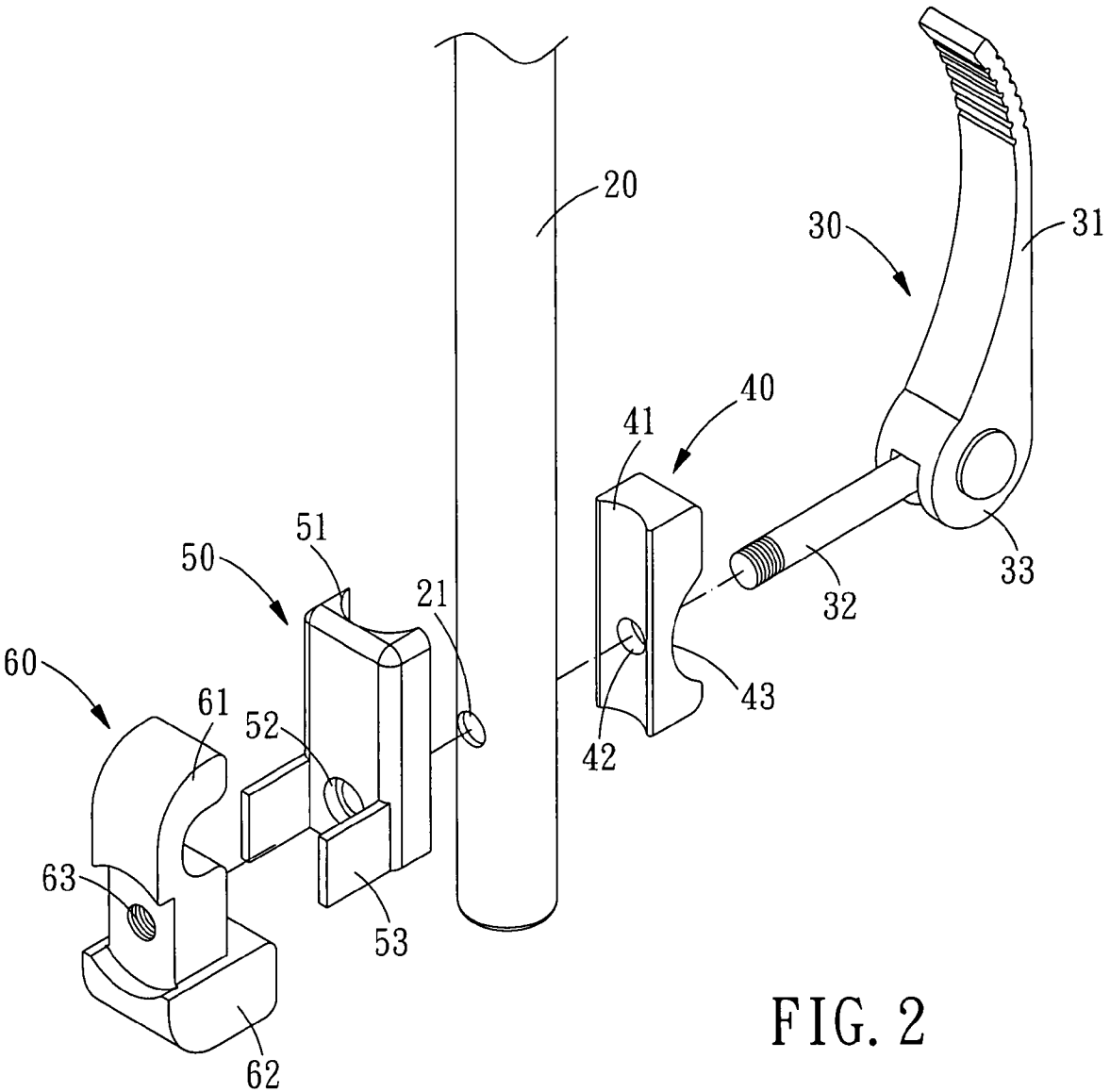
FIG. 2 is an exploded view of a net-post assembly for ball game in accordance with a first preferred embodiment of the present invention.

Referring to FIG. 2, a net-post assembly for ball game in accordance with a preferred embodiment of the present invention is shown and comprises: a rod 20, a quick release member 30, a first clamping member 40, a second clamping member 50 and a fastener 60.

The rod 20 has an elongated shape and is circular in cross section, on a periphery of the rod 20 is formed a through hole 21.

The quick release member 30 includes a handle 31 and a rod portion 32. At the end of the rod portion 32 are formed a plurality of threads, and the rod portion 32 is to be inserted in the through hole 21 of the rod 20. At the connection between the handle 31 and the rod portion 32 is provided a cam 33.

The first clamping member 40 is formed at a side thereof with arc surface 41 for mating with the profile of the rod 20. On the arc surface 41 is defined a through hole 42 that is aligned to the through hole 21 and provided for passage of the rod portion 32 of the quick release member 30. At another side of the first clamping member 40 is further defined an arc notch 43 which is formed in response to the profile of the cam 33 of the quick release member 30. The arc notch 3 of the first clamping member 40 is provided for accommodation of the cam 33 of the quick release member 30.

The second clamping member 50 is provided at a side thereof with an arc surface 51 formed in response to the profile of the rod 20, on the arc surface 41 is defined a through hole 52 that is aligned to the through hole 21 and provided for passage of the rod portion 32 of the quick release member 30. On another side of the second clamping device 50 opposite the arc surface 51 are provided two flat stop portions 53 oppositely arranged in parallel to each other.

The fastener 60 includes a fastening portion 61 and a projection 62. The fastening portion 61 is provided with a threaded through hole 63 that is aligned to the through hole 52 of the second clamping member 50 and is used to screw with the rod portion 32 of the quick release member 30. The top edge of the projection 62 of the fastener 60 will abut against the lower edge of the stop portions 53 of the second clamping device 50 in such a manner that both sides of the fastening portion 61 are confined between the stop portions 53.

Figure 3:
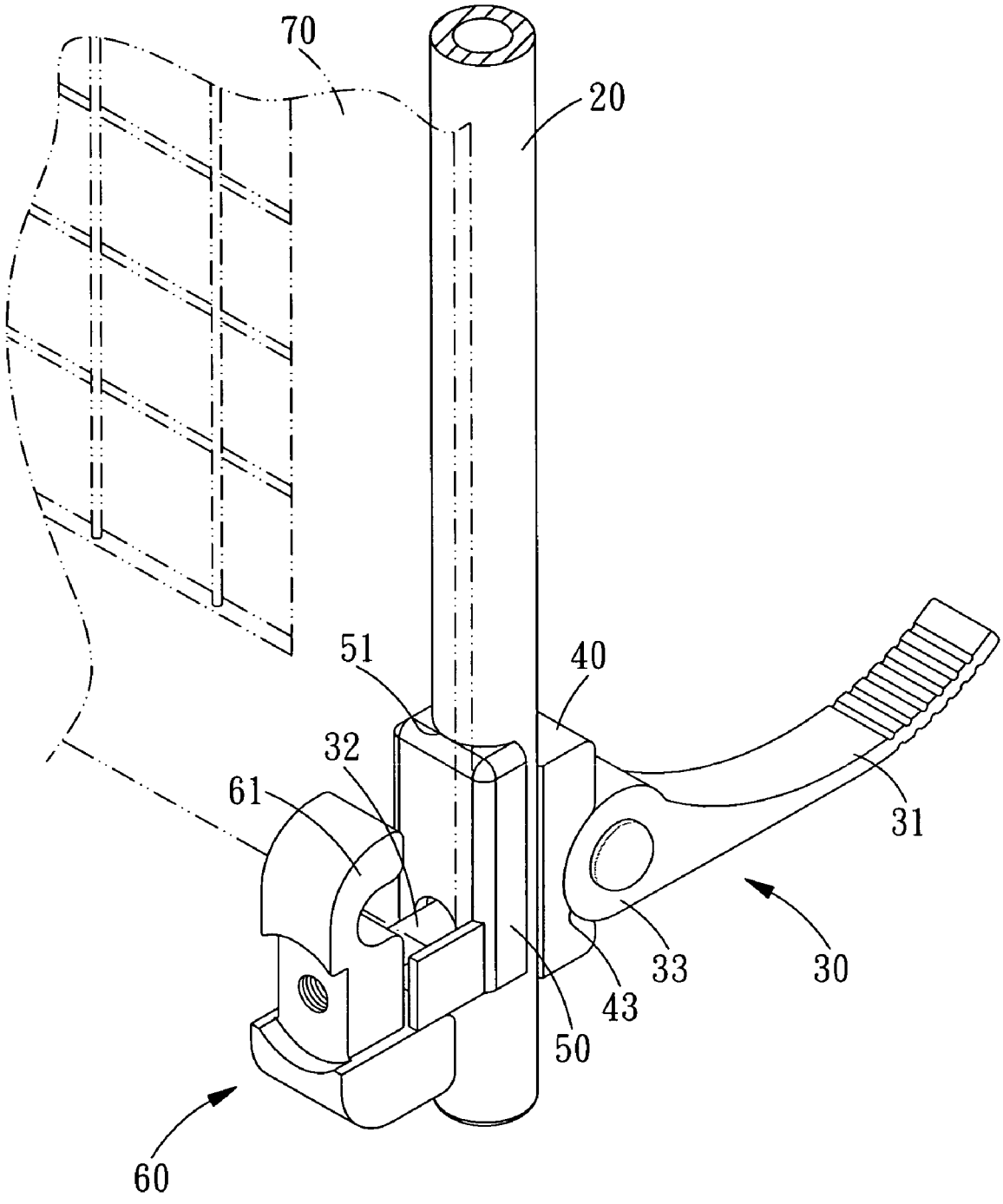
FIG. 3 is an illustrative view of showing the net-post assembly before adjustment.
Figure 4:
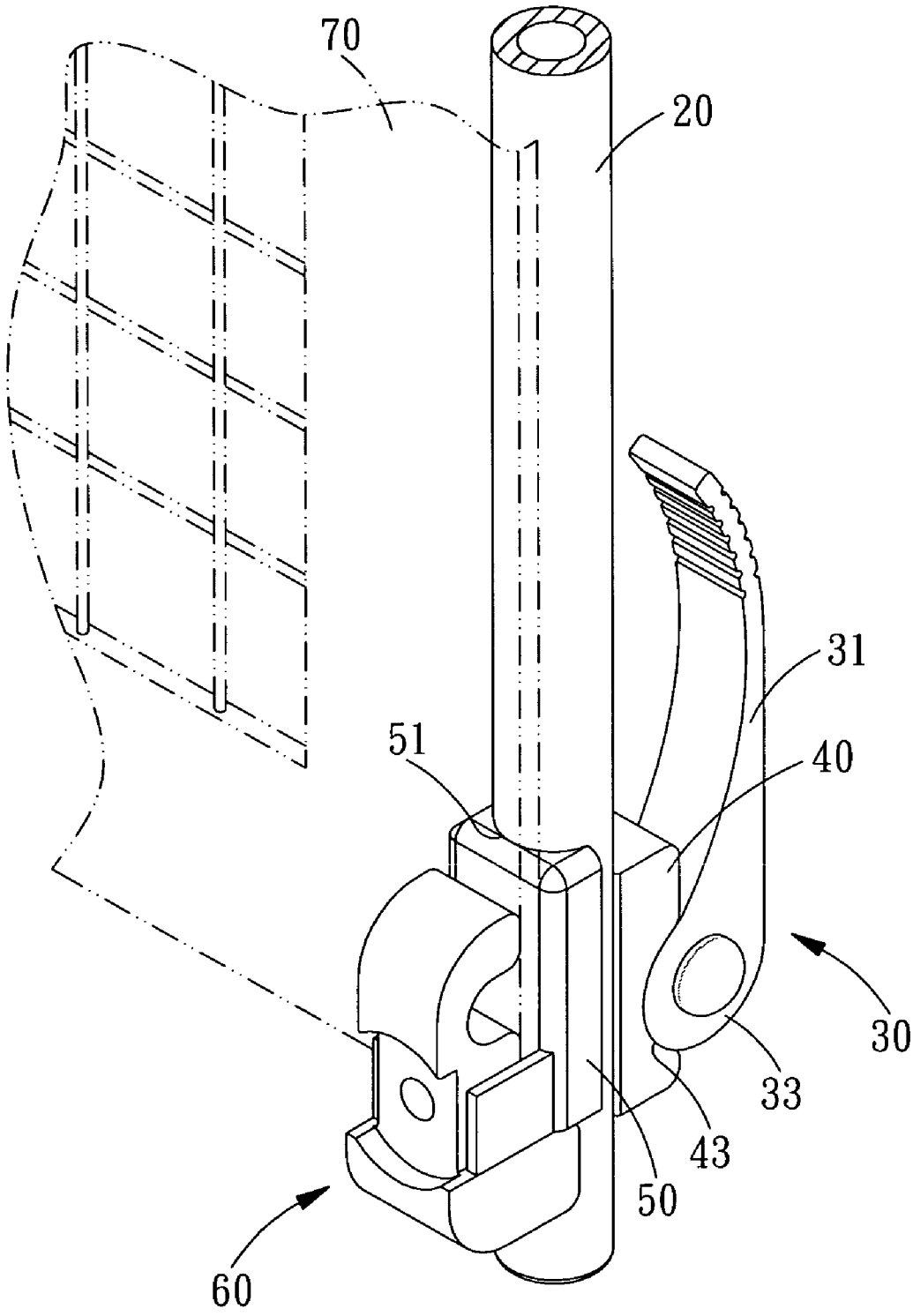
FIG. 4 is an illustrative view of showing the net-post assembly after adjustment.

For a better understanding of the present invention, its operations and functions, references should be made to FIGS. 3 and 4. In assembly, the user can put a lower edge of a net 70 between an outer surface of the second clamping member 50 and the inner surface of the fastening portion 61 of the fastener 60, and then pull the handle 31 of the quick release member 30 upward to tighten the fastener 60 with the rod portion 32. Meanwhile, the cam 33 of the quick release member 30 pushes against the arc notch 43 of the first clamping member 40. Consequently, the arc surfaces 41, 51 of the first and the second clamping members 40, 50 will be pushed closely against the rod 20, and thus the net is tightly clamped between the second clamping member 50 and the fastener 60.

Figure 5:
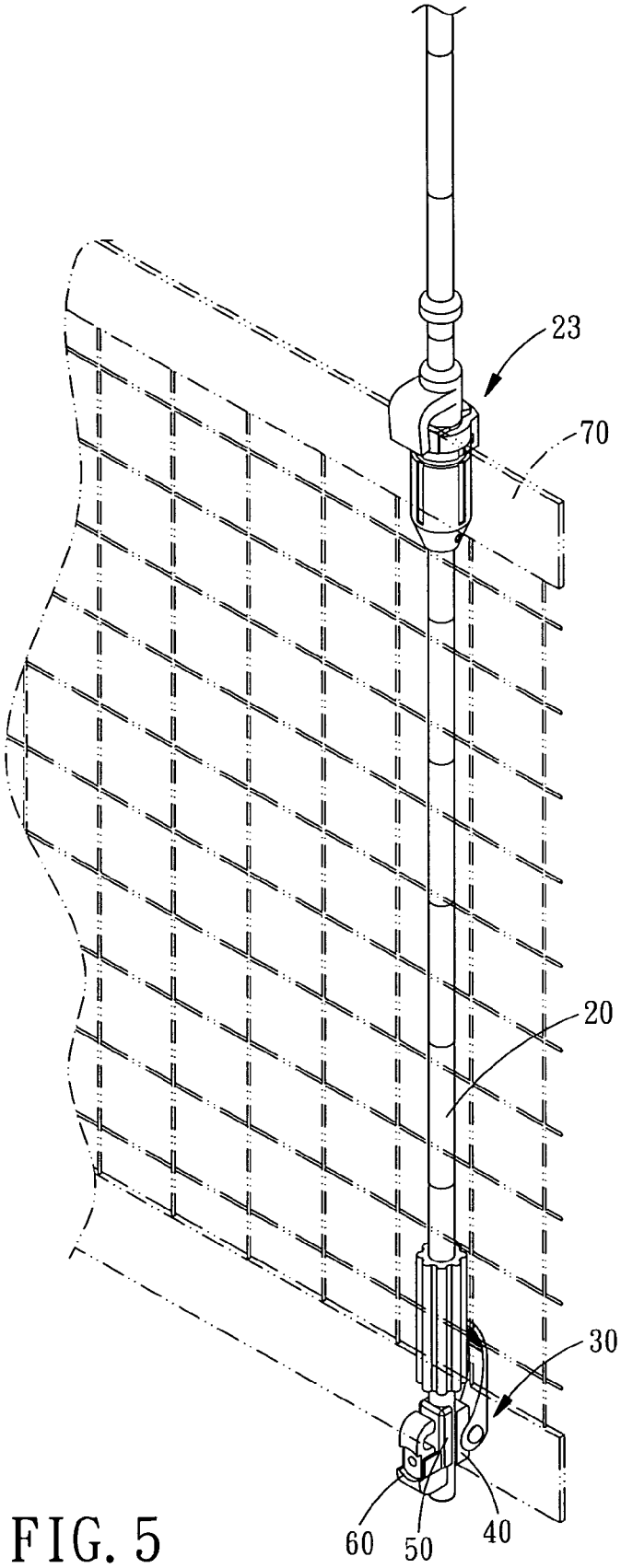
FIG. 5 is an operational view of the net-post assembly for ball game in accordance with the first preferred embodiment of the present invention.

The rod 20 is provided at its upper end with a clamping structure 23 for positioning the upper edge of the net (as shown in FIG. 5), therefore, the net 70 can be clamped on the rod 20 simply by pulling the quick release member 30.

In disassembly, it only needs to pull the quick release member 30 and loosen the clamping structure 23, then the net 70 can be released form the rod 20 for allowing the user to disassemble the rod 20 more easily.

Figure 6:
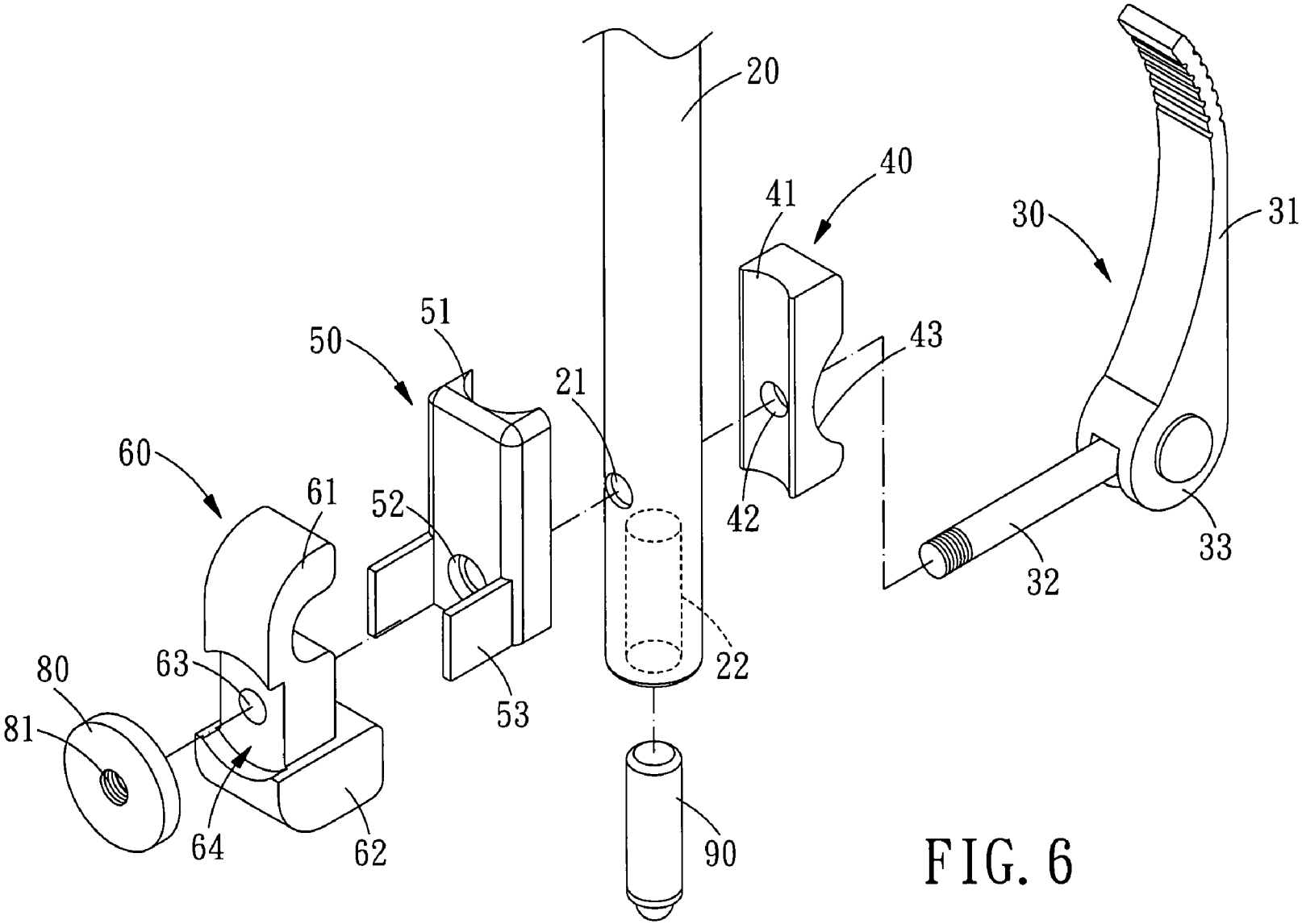
FIG. 6 is an exploded view of a net-post assembly for ball game in accordance with a second preferred embodiment of the present invention.

Referring to FIG. 6, a net-post assembly for ball game in accordance with a second preferred embodiment of the present invention is shown and is similar to that of the previous embodiment, except that:

On a side of the fastening portion 61 of the fastener 60 is formed a recess 64 in which is received a washer 80 having a central threaded hole 81. The rod portion 32 of the quick release member 30 inserts through the through holes 42, 21 and 52 of the first clamping member 40, the rod 20 and the second clamping member 50, respectively, and is finally screwed in the threaded hole 81 of the washer 80.

Furthermore, on the bottom of the rod 22 is formed a hole 22 for insertion of a laser indicator 90, after the net 70 is mounted the rod 20, the laser light projected from the laser indicator 90 is aligned to the sideline of the court, so that the rod 22 can be aligned precisely to the sideline of the court.

While we have shown and described various embodiments in accordance with the present invention, it should be clear to those skilled in the art that further embodiments may be made without departing from the scope of the present invention.

What is claimed is:

1. A net-post assembly for ball game comprising:

a rod having an elongated shape and being circular in cross section, on a periphery of the rod being formed a through hole;

a quick release member inserted in the through hole of the rod;

a first clamping member provided with an arc surface for mating with profile of the rod, on the arc surface formed a through hole being aligned to the through hole and provided for passage of the rod portion of the quick release member;

a second clamping member provided with an arc surface for mating with profile of the rod, on the arc surface formed a through hole being aligned to the through hole and provided for passage of the rod portion of the quick release member;

a fastener provided with a through hole being aligned to the through hole of the second clamping member for positioning the quick release member;

by such arrangements, a net will be clamped between the second clamping member and the fastener simply by the adjusting the quick release member.

2. The net-post assembly for ball game as claimed in claim 1, wherein the second clamping device is provided at a side thereof opposite its arc surface with two flat stop portions that are oppositely arranged in parallel to each other.

3. The net-post assembly for ball game as claimed in claim 1, wherein the fastener includes a fastening portion and a projection, the through hole of the fastener is formed on the projection.

4. The net-post assembly for ball game as claimed in claim 3, wherein the fastening portion of the fastener is formed a recess in which is received a washer having a central threaded hole, and the quick release member is screwed in the threaded hole of the washer.

* * * * *